US007501929B2

(12) United States Patent
Lawrence et al.

(10) Patent No.: US 7,501,929 B2
(45) Date of Patent: Mar. 10, 2009

(54) ACTUATOR WITH INTEGRAL POSITION SENSOR

(75) Inventors: Donald Robertson Lawrence, Etobicoke (CA); Steven Donald Keddie, Mississauga (CA); Mike Joseph Chalovich, Mississauga (CA); Yulanda Youhong Wang, Mississauga (CA)

(73) Assignee: CTS Corporation, Elkhart, IN (US)

( * ) Notice: Subject to any disclaimer, the term of this patent is extended or adjusted under 35 U.S.C. 154(b) by 3 days.

(21) Appl. No.: 11/524,223

(22) Filed: Sep. 20, 2006

(65) Prior Publication Data

US 2007/0013473 A1 Jan. 18, 2007

Related U.S. Application Data

(63) Continuation of application No. 10/917,741, filed on Aug. 13, 2004, now Pat. No. 7,116,210.

(60) Provisional application No. 60/568,308, filed on May 5, 2004.

(51) Int. Cl.
*H01C 10/14* (2006.01)

(52) U.S. Cl. ..... 338/116

(58) Field of Classification Search ..... 338/116
See application file for complete search history.

(56) References Cited

U.S. PATENT DOCUMENTS

| | | | | |
|---|---|---|---|---|
| 3,047,751 | A * | 7/1962 | Hudson | 310/72 |
| 5,963,124 | A * | 10/1999 | Buss et al. | 338/162 |
| 6,031,448 | A * | 2/2000 | Starkweather et al. | 338/106 |
| 6,622,589 | B1 * | 9/2003 | Pino et al. | 74/513 |
| 6,639,508 | B1 * | 10/2003 | Martin | 338/162 |

* cited by examiner

*Primary Examiner*—Elvin G Enad
*Assistant Examiner*—Joselito Baisa
(74) *Attorney, Agent, or Firm*—Mark P. Bourgeois

(57) ABSTRACT

An actuator and integral position sensor has increased reliability with a fail-safe mode. The actuator and sensor assembly includes a rotary actuator that has a driving shaft. A sensor rotor has the driving shaft mounted in a bore. A contactor is mounted to an outer edge of the rotor. The contactor is engaged with a resistor film as the rotor rotates. A driven shaft is mounted to the rotor in another bore. The rotor couples the driving shaft and the driven shaft together.

12 Claims, 5 Drawing Sheets

ACTUATOR WITH INTEGRAL POSITION SENSOR

CROSS-REFERENCE TO RELATED AND CO-PENDING APPLICATIONS

This application is a continuation of U.S. patent application Ser. No. 10/917,741, filed on 13 Aug. 2004, and titled, "Actuator with Integral Position Sensor", which claims priority to U.S. Provisional Patent Application Ser. No. 60/568,308 filed on 5 May 2004, and titled, "Actuator with Integral Position Sensor", The contents or which are explicitly incorporated by reference.

BACKGROUND

The present invention relates to actuators in general and in particular to a rotary actuator with an integral position sensor.

Prior actuators combined with position sensors have sensed the position of the actuator and not the device that is to be moved by the actuator. Unfortunately, in the case where there is a failure in the mechanical link between the actuator and the driven device, the position of the driven device is unknown. The position sensor coupled to the actuator will continue to report the position of the actuator even when the driven device is in a different location. Such a situation is undesirable and can be dangerous in certain applications.

An unmet need exists for an actuator with an integral position sensor that has increased reliability and is fail safe.

SUMMARY OF THE INVENTION

It is a feature of the present invention to provide an actuator with an integral position sensor.

It is a feature of the present invention to provide an actuator with an integral position sensor that has increased reliability and that has a fail safe mode.

It is a feature of the present invention to provide an actuator and sensor assembly that includes a rotary actuator that has a driving shaft extending therefrom. A rotor has a first bore, a first flange, a second bore, a second flange and a groove. The first bore is coaxial with the second bore. The driving shaft is mounted in the first bore and is engaged with the first flange such that rotation of the driving shaft rotates the rotor. A contactor is mounted to an outer edge of the rotor. The contactor is engaged with the resistor film as the rotor rotates. The contactor and resistor film form a variable resistor. A driven shaft is mounted in the second bore and is engaged with the second flange. The rotor couples the driving shaft and the driven shaft together.

BRIEF DESCRIPTION OF THE DRAWINGS

It is noted that the drawings of the invention are not to scale. In the drawings, like numbering represents like elements among the drawings.

DETAILED DESCRIPTION

Figure 1:
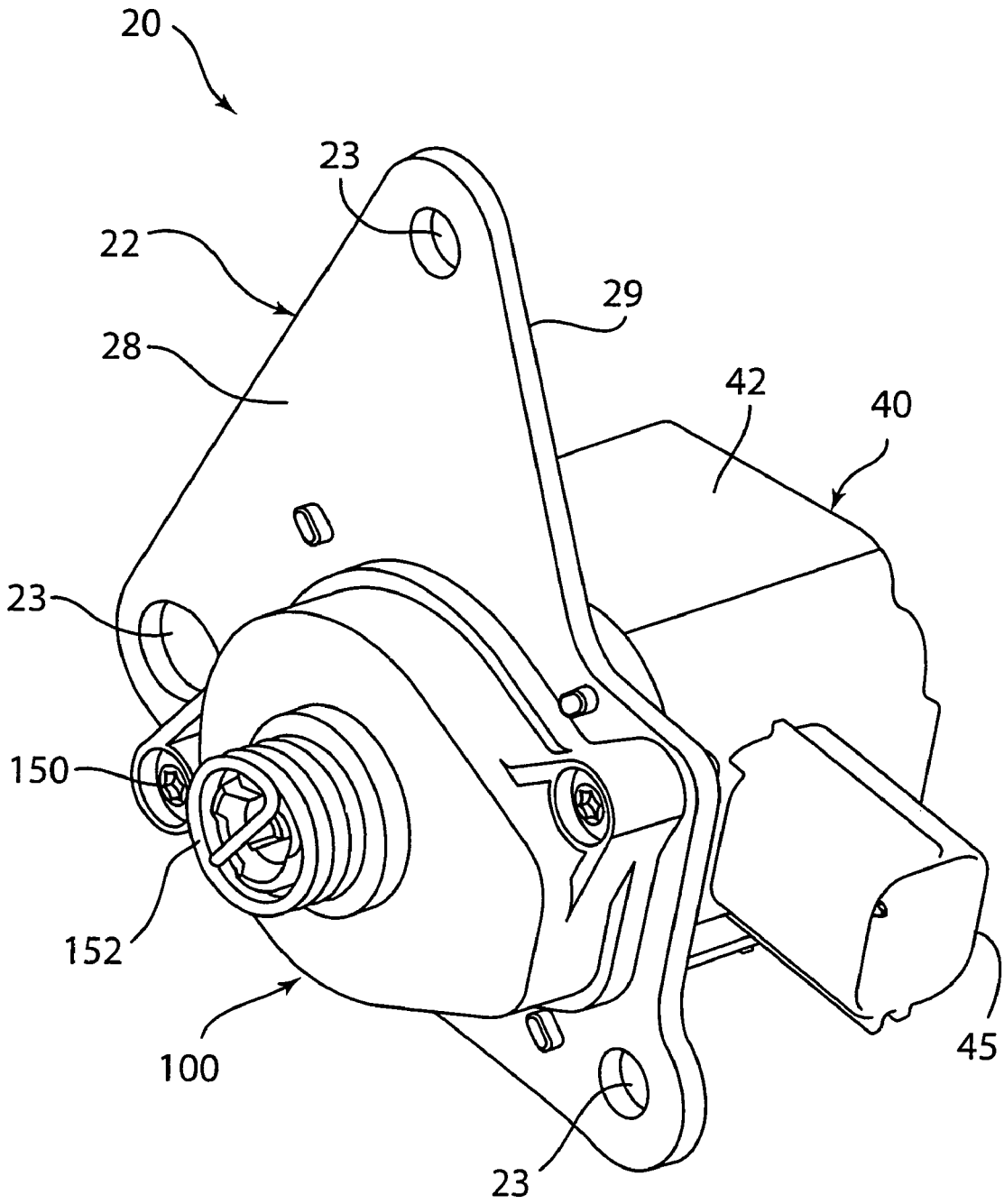
FIG. 1 is a perspective view of an actuator and sensor assembly.
Figure 2:
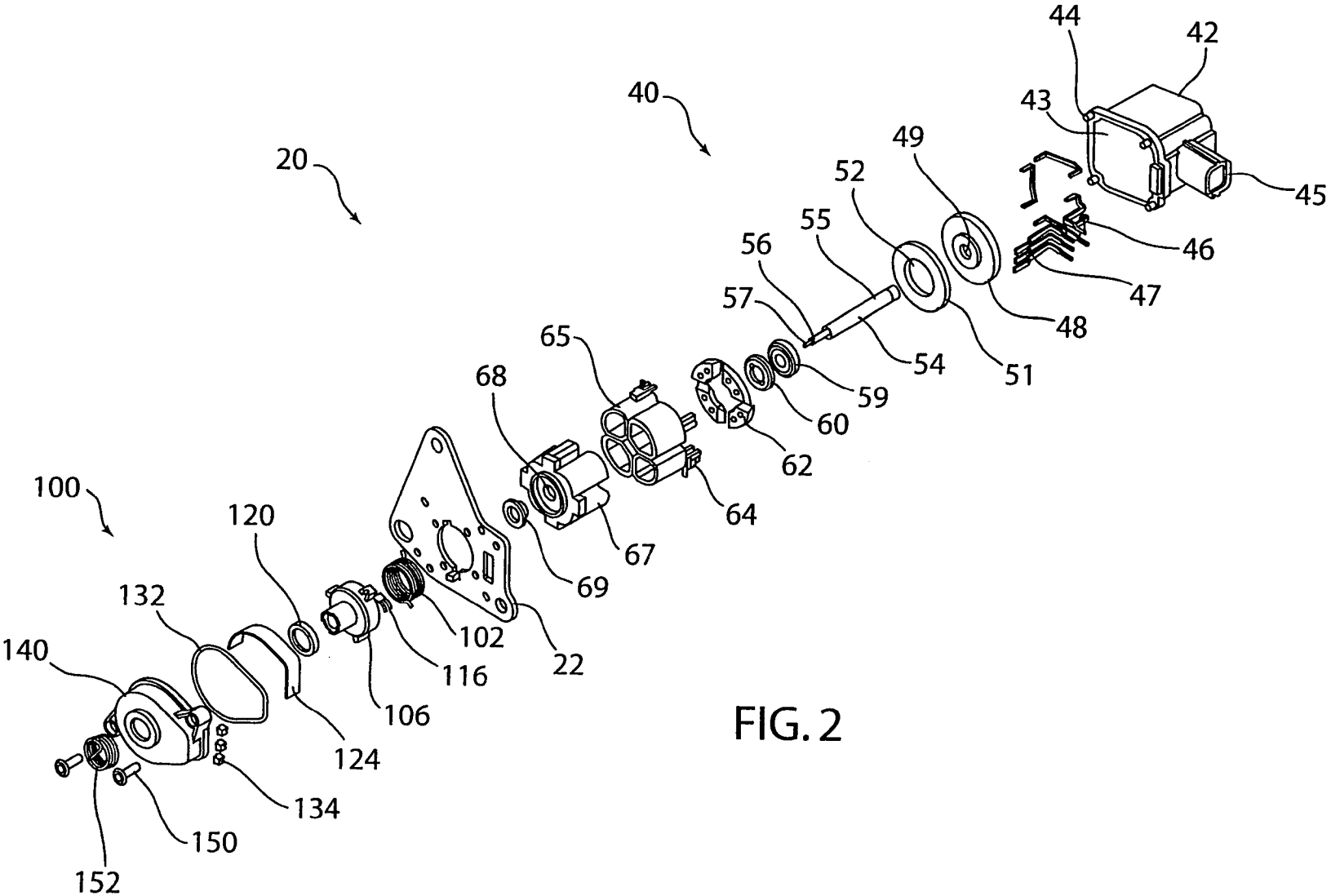
FIG. 2 is an exploded view of the actuator and sensor assembly of FIG. 1.
Figure 3:
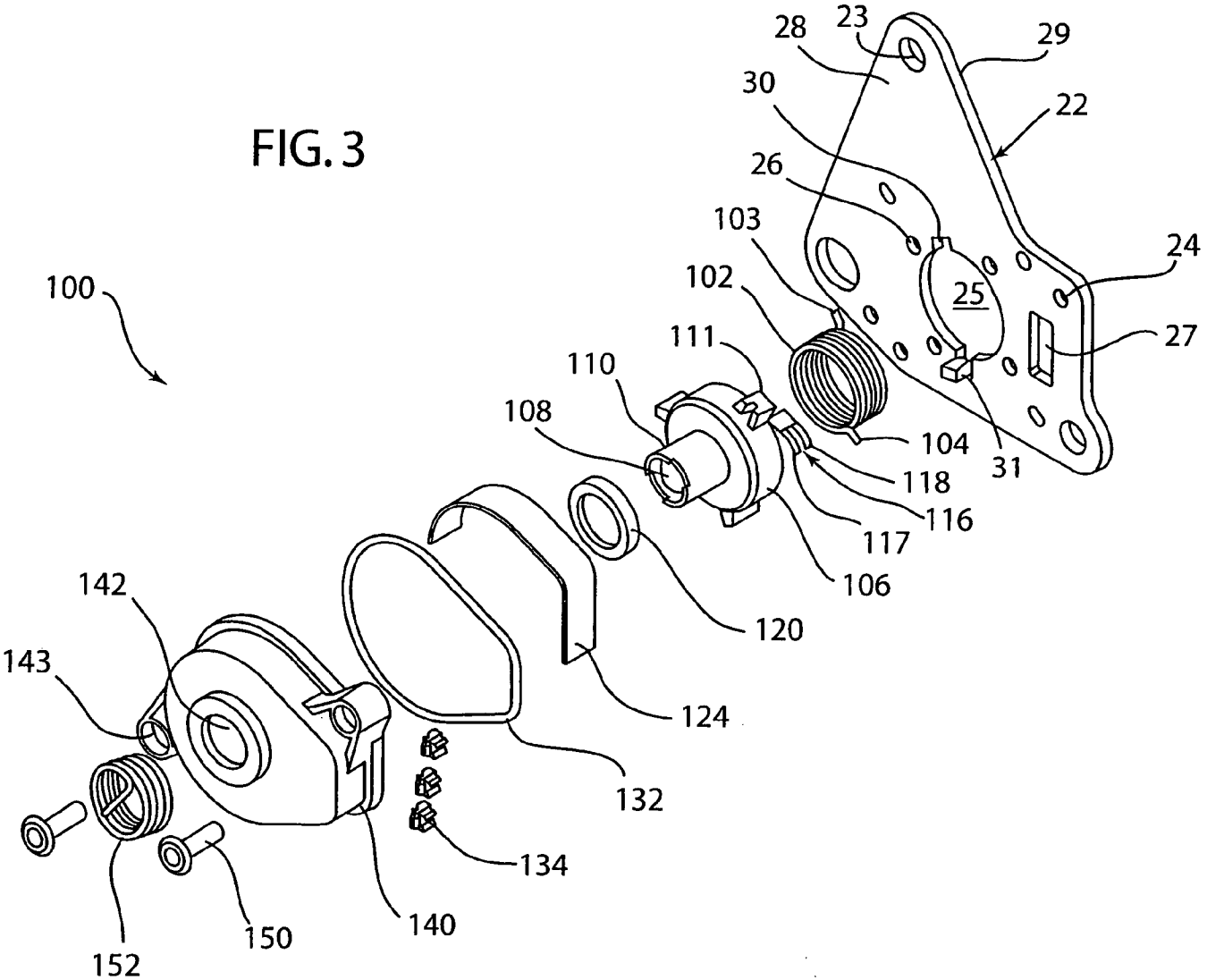
FIG. 3 is an enlarged view of the sensor portion of FIG. 2.

Referring to FIGS. 1-5, an embodiment of an actuator and sensor assembly 20 is shown. Actuator and sensor assembly 20 has an actuator 40 and a sensor 100. A bracket 22 is located between actuator 40 and sensor 100. Bracket 22 has a manifold mounting hole 23, a sensor mounting hole 24, a shaft hole 25, an actuator mounting hole 26, a slot 27, a side 28, a side 29, a notch 30 and a tab 31. Actuator 40 is mounted on side 29. Sensor 100 is mounted on side 28. Bracket 22 is mounted to an intake manifold 200 of an internal combustion engine. Screws 204 are fastened through manifold mounting holes 23 to hold assembly 200 to intake manifold 200.

Actuator

Actuator 40 is a electromechanical stepper motor that has a high ratio of torque per mass and torque per power draw. Actuator 40 also has a magnetic circuit that allows a significant holding torque while using a limited amount of electric power.

Actuator 40 has a housing 42. Housing 42 has a cavity 43, pins 44 that extend from one end of housing 42 and a connector flange 45. Actuator terminals 46 are mounted in cavity 43. One end of terminals 46 are located in connector flange 45 and the other ends are located in cavity 43. Sensor terminals 47 are mounted in cavity 43. One end of terminals 47 are located in connector flange 45 and the other ends extend through slot 27 to sensor 100. A wire harness (not shown) would mate with connector flange 45 to provide power and control signals to actuator 40.

Actuator 40 has soft-magnetic parts that make up the magnetic circuits of the motor, namely: a stator 67 and a rotor 48. Stator 67 has a hole 68. Rotor 48 has a hole 49 and a respective multi-pole magnet 51 that is attached to rotor 48. Magnet 51 has a hole 52 and alternating north and south regions. Poles 62 are mounted to bobbin 64.

A bobbin 64 includes four coils of conventional wire windings 65. By regulating either the direction of current passing through the wire or by changing the direction of the winding of the coils, each column can become a north or south electromagnet.

A driving shaft or actuator shaft 54 has ends 55 and 56. End 56 is coupled to rotor 48 via a flat portion 57 extending into bore 107. Shaft 54 extends through magnet 51, stator 67 and hole 25. A bearing 59 and bushing 69 support shaft 54. Bearing 59 is retained by a bearing support 60.

Sensor

Sensor 100 is mounted on side 28 of bracket 22. Sensor 100 has a housing 140 that is mounted to bracket 22. Housing 140 has a cavity 141, a hole 142, screw holes 143, slot 144 and posts 145. Screws 150 fasten housing 140 to bracket 22. O-ring 132 forms a seal between bracket 22 and housing 140.

Rotor 106 is mounted inside housing 140. Rotor 106 has a bore 107, 108, groove 109, flange 110 and post 111. Shaft end 56 is mounted in bore 107 with flat 57 engaged with a corresponding area in the bore. Shaft 54 thereby can rotate rotor 106. Primary spring 102 is mounted in groove 109. Primary spring 102 has an end 103 and an end 104. End 103 is held by notch 30 and end 104 is held in groove 109. Spring 102 biases rotor 106 to a fail safe position.

A metal bi-furcated contactor 116 is mounted to post 111. Contactor 116 has ends 117 and 118. Contactor 116 is heat staked to post 111. Contactor 116 can be made out of a precious metal alloy such as Paliney 16. Flange 110 extends through hole 142 of cover 140. Seal 120 is mounted around and seals flange 110.

A polyimide film or element 124 is mounted in slot 144 between posts 145. Film 124 has a pair of resistor tracks 125, a pair of conductors 126 and a pair of contact pads 127 and 128. Clips 134 are pressed over contact pads 127, 128 and sensor terminals 47. The clips make an electrical connection between the contact pads and the sensor terminals. The end 117 of contactor 116 is in contact with one of the resistors 125. The other end 118 is in contact with the other resistor 125.

In operation, as rotor 54 rotates, ends 117 and 118 wipe or slide along resistor tracks creating a potentiometer. A voltage is applied between contact pads 127 and 128, as contactor 116 slides, the voltage drop changes across the resistors and at contact pads 127 and 128. Terminals 47 would be connected to external signal conditioning circuitry. As is well known in the art, the angular position of the actuator can be determined from the voltage level. The external signal conditioning circuitry may be added internally to the sensor, if desired.

Actuator and Sensor Mounting

Figure 4:
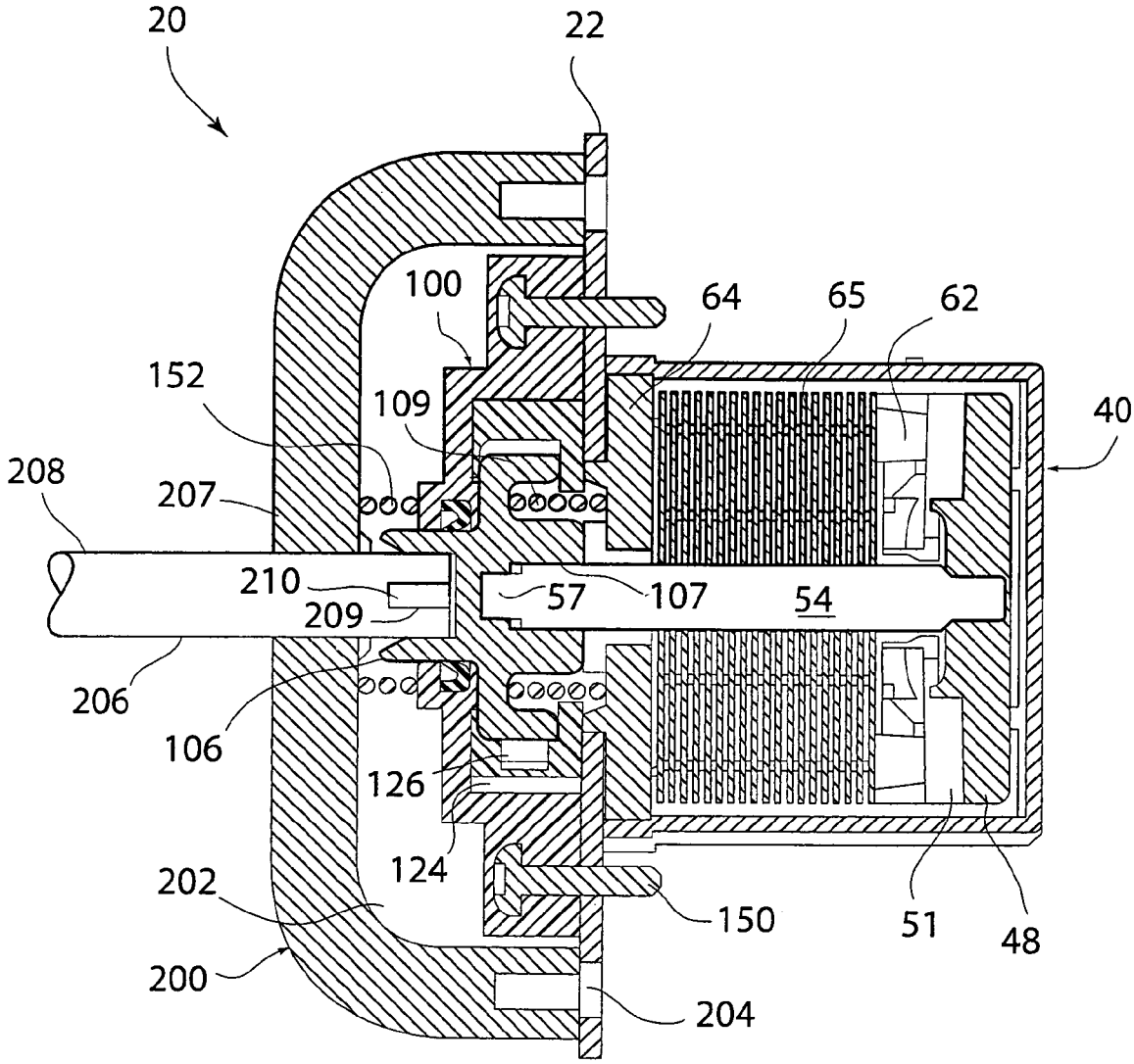
FIG. 4 is a cross-sectional view of the actuator and sensor assembly of FIG. 1.
Figure 5:
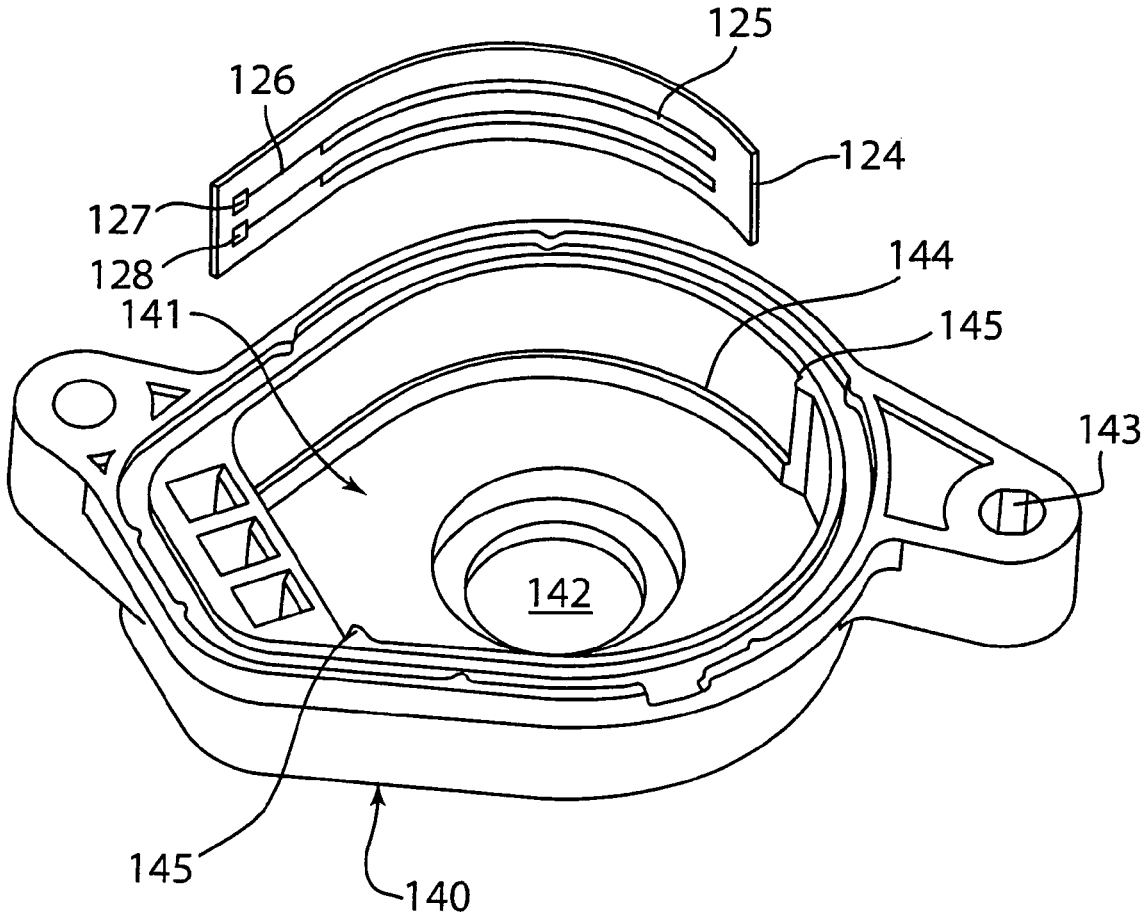
FIG. 5 is a perspective view of the inside of the sensor housing and resistor film.

Referring to FIG. 4, actuator and sensor assembly 20 is shown mounted to an intake manifold 200 of an internal combustion engine. Manifold 200 has a cavity 200. Screws 204 are used to attached manifold 200 to bracket 22. A driven shaft or manifold valve shaft 206 has ends 207, 208 and a notch 209. End 207 is retained and held in bore 108. End 207 can be held by a metal flat portion 210 in bore 108 engaging notch 209. Manifold value shaft 206 would be attached to a valve or valves (not shown) in runners of an intake manifold. The purpose of the valves is to increase mixing and atomization of the fuel/air mixture. A secondary spring 152 is mounted around flange 110 between housing 140 and intake manifold 200. Secondary spring 152 is attached to rotor 106. Spring 152 biases rotor 106 to a fail safe position.

In the event of a failure of shaft 54 or 206, springs 102 and 152 will bias rotor 106 such that contactor 116 is disengaged from resistors 125 resulting in an open circuit with zero voltage. This mode is shown in FIG. 4 where the contactor does not touch film 124. An engine controller can be programmed to read the zero voltage output from the sensor and respond by controlling the engine in an appropriate manner.

Discussion

One of ordinary skill in the art of designing and using actuators and sensors will realize many advantages from using the present invention. The use of two shafts, one connected to each side of the sensor, provides for a fail-safe sensor that always reads the true position of the valve shaft.

An additional advantage of the present invention is in case of a failure of either shaft, the rotor will rotate such that the contactors are disengaged from the resistors resulting in an open circuit with zero voltage. An engine controller can be programmed to read the zero voltage output from the sensor and respond by controlling the engine in an appropriate manner.

Another advantage of the present invention is that the sensor is well sealed from environmental contamination.

Another advantage of the present invention is that the sensor is not only connected to the actuator but is connected to the object whose position is desired to be sensed.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An actuator and sensor assembly comprising:

a motor having a shaft, the shaft having a first end, a second end and a flat portion located at the second end, the first end of the shaft mounted in the motor and the second end of the shaft extending from the motor;

a connector flange extending from the motor;

a housing coupled to the motor, the housing having a cavity and a wall;

a rotor mounted in the cavity, the rotor having an outer edge and at least one bore, the shaft passing into the bore with the flat portion of the shaft engaged with the bore such that the rotor is coupled to the shaft;

a film disposed adjacent to the wall;

a resistor mounted to the film;

a contactor mounted to the outer edge of the rotor, the contactor being adapted to contact the resistor as the rotor rotates, the contactor and the resistor forming a potentiometer;

a first spring coupled to the rotor, the first spring adapted to bias the rotor toward a first position;

a first terminal mounted in the connector flange and extending through the motor and into the housing, the first terminal electrically connected to the resistor; and a second terminal mounted in the connector flange and electrically connected to the motor.

2. The actuator and sensor assembly according to claim 1, wherein the contactor is disengaged from the resistor in the first position.

3. The actuator and sensor assembly according to claim 1, wherein the resistor is connected to the first terminal by a clip.

4. The actuator and sensor assembly according to claim 1, wherein a bracket is mounted between the motor and the housing.

5. The actuator and sensor assembly according to claim 1, wherein a second spring is coupled to the rotor for biasing the rotor towards the first position.

6. The actuator and sensor assembly according to claim 1, wherein the rotor has a groove, the first spring being mounted in the groove.

7. A sensor assembly comprising:

an actuator having a shaft, the actuator being adapted to rotate the shaft, the shaft having first and second ends, the first end of the shaft being mounted in the actuator and the second end of the shaft extending from the actuator;

a connector flange extending from the actuator;

a housing coupled to the actuator, the housing having a cavity and a wall, the shaft extending into the housing;

a rotor mounted in the cavity and coupled to the second end of the shaft, the rotor having a post and a first bore, the second end of the shaft being mounted in the first bore;

a film coupled to the wall;

a resistor mounted to the film;

a contactor mounted to the post, the contactor being adapted to contact the resistor as the rotor rotates, the contactor and the resistor forming a potentiometer, the potentiometer operable to provide an electrical signal that is indicative of the position of the shaft; and a spring coupled between the motor and the rotor for biasing the rotor to a first position;

a first terminal mounted in the connector flange and extending through the actuator and into the housing, the first terminal being electrically connected to the resistor; and a second terminal mounted in the connector flange and electrically connected to the actuator.

8. The sensor assembly according to claim 7, wherein the resistor is connected to the first terminal by a clip.

9. The sensor assembly according to claim 7, wherein a bracket is mounted between the actuator and the housing.

10. An actuator and sensor assembly comprising:

an electric motor having a shaft, the motor being adapted to rotate the shaft, the shaft having first and second ends, the first end of the shaft being mounted in the electric motor and the second end of the shaft extending from the electric motor;

a connector flange extending from the motor;

a housing coupled to the motor, the housing defining an aperture, a cavity and a wall, the shaft extending into the housing;

a rotor mounted in the cavity and coupled to the shaft, the rotor having a flange, a first bore and a groove, the second end of the shaft being mounted in the first bore, the flange extending through the aperture defined in the housing;

a film coupled to the wall;

a resistor mounted to the film;

a contactor mounted to the rotor, the contactor being adapted to contact the resistor as the rotor rotates, the contactor and the resistor forming a potentiometer, the potentiometer operable to provide an electrical signal that is indicative of the position of the motor; and a spring coupled to the rotor for biasing the rotor to a first position;

a first terminal mounted in the connector flange and extending through the actuator and into the housing, the first terminal being electrically connected to the resistor; and a second terminal mounted in the connector flange and electrically connected to the actuator.

11. The sensor assembly according to claim 10, wherein the resistor is connected to the first terminal by a clip.

12. The sensor assembly according to claim 10, wherein the spring is mounted in the groove.

* * * * *